US006851915B2

(12) United States Patent
Warner et al.

(10) Patent No.: US 6,851,915 B2
(45) Date of Patent: Feb. 8, 2005

(54) LOAD HANDLING DEVICE FOR AN INDUSTRIAL TRUCK

(75) Inventors: Barry Michael Warner, Hants (GB); David John Brown, Hants (GB)

(73) Assignee: Linde Aktiengesellschaft (DE)

( * ) Notice: Subject to any disclaimer, the term of this patent is extended or adjusted under 35 U.S.C. 154(b) by 244 days.

(21) Appl. No.: 10/143,555

(22) Filed: May 10, 2002

(65) Prior Publication Data

US 2003/0007856 A1 Jan. 9, 2003

(30) Foreign Application Priority Data

May 11, 2001 (GB) ..... 0111614

(51) Int. Cl.[7] ..... B66F 9/08; B66F 9/14
(52) U.S. Cl. ..... 414/667; 414/631; 414/661
(58) Field of Search ..... 414/631, 659, 414/661, 663, 664, 667; 187/238

(56) References Cited

U.S. PATENT DOCUMENTS

| | | | | | |
|---|---|---|---|---|---|
| 1,813,597 | A | * | 7/1931 | Abbe | 414/667 |
| 2,973,878 | A | * | 3/1961 | Gibson | 414/664 |
| 3,235,105 | A | * | 2/1966 | Loomis | 414/544 |
| 3,715,046 | A | * | 2/1973 | Marklund | 414/632 |
| 4,523,887 | A | * | 6/1985 | Reiff | 414/664 |
| 4,636,131 | A | * | 1/1987 | Sinclair | 414/621 |
| 4,943,203 | A | * | 7/1990 | Bohata | 414/486 |
| 4,998,858 | A | * | 3/1991 | Magens | 414/495 |
| 5,114,294 | A | * | 5/1992 | Attman | 414/11 |
| 5,468,116 | A | * | 11/1995 | Reichert et al. | 414/607 |
| 5,480,275 | A | * | 1/1996 | Talbert et al. | 414/635 |
| 5,788,452 | A | * | 8/1998 | Brouwer et al. | 414/631 |
| 5,823,737 | A | * | 10/1998 | Cook | 414/621 |
| 2004/0101392 | A1 | * | 5/2004 | Drake | 414/664 |

FOREIGN PATENT DOCUMENTS

| | | |
|---|---|---|
| GB | 866192 | 4/1961 |
| GB | 4 469 528 | 4/1977 |
| GB | 2 022 552 | 12/1979 |

* cited by examiner

*Primary Examiner*—James W. Keenan
(74) *Attorney, Agent, or Firm*—Webb Ziesenheim Logsdon Orkin & Hanson, P.C.

(57) ABSTRACT

The subject of the invention is a load handling device for an industrial truck having a lift frame, a lift carriage which can be displaced along the lift frame, and a reach carriage guided so as to move on the lift carriage. A load pick-up device is arranged on the reach carriage. According to the invention, the lift carriage is guided on the outer sides of the lift frame by rollers, and the reach carriage is guided on the outer sides of the lift carriage. In order to displace the reach carriage, a hydraulic reach cylinder is provided on each side of the lift frame and is fixed at one end to the lift carriage and at the other end to the reach carriage.

26 Claims, 5 Drawing Sheets

LOAD HANDLING DEVICE FOR AN INDUSTRIAL TRUCK

CROSS-REFERENCE TO RELATED APPLICATION

This application claims priority to British Application No. 0111614.4 filed May 11, 2001, and herein incorporated by reference in its entirety.

BACKGROUND OF THE INVENTION

1. Field of the Invention

The invention relates to a load handling device for an industrial truck having a lift frame, a lift carriage which can be displaced along the lift frame, and a reach carriage guided so as to move on the lift carriage, a load pick-up means being arranged on the reach carriage.

2. Technical Considerations

In load handling devices of this type, the lift frame is firmly connected to a vehicle frame of the industrial truck. The lift carriage can be moved along the lift frame in the vertical direction. The reach carriage can be displaced relative to the lift carriage in the essentially horizontal direction, in the longitudinal direction of the industrial truck. The load pick-up means, generally designed as load forks, is rigidly connected to the reach carriage, in the case of a design without a side shift device, or forms a common component with the reach carriage. In the case of a design with a side shift device, the load pick-up means can be displaced in the lateral direction of the industrial truck, that is to say perpendicular to the direction of movement of the reach device.

Arrangements having a reach device for the load pick-up devices are known, for example, in the case of so-called reach fork-lift trucks, in which the reach device is generally formed by a scissors-type device. The scissors-type device is normally located between the lift carriage and the load pick-up device. However, this enlarges the front-end dimension of the load handling device, as a result of which the center of gravity of a load that is picked up is displaced forwards in an unfavorable way.

The invention is, therefore, based on the object of providing a load handling device of the generic type for an industrial truck which can be produced simply and has a low front-end dimension.

SUMMARY OF THE INVENTION

According to the invention, this object can be achieved in that the lift carriage is guided on the outer sides of the lift frame by means of rollers, and in that the reach carriage is guided on the outer sides of the lift carriage. In the arrangement according to the invention, the travelling masts, which can be extended upwards, are arranged on the outside of the lift frame and guided on the outer sides of the stationary masts, whose height is not adjustable. The C-shaped lift carriage is in turn guided on the outer sides of the travelling masts and at the same time engages around the lift frame. The reach carriage is guided in the side area of the lift carriage, as a result of which no guide components are arranged in the front direction between the lift carriage and the reach carriage. The overall length of the load handling device is, therefore, minimized in the frontal direction.

The reach carriage is expediently guided on the lift carriage by means of rollers, and the rollers for guiding the reach carriage on each side of the lift frame are each assigned an upper and a lower guide rail. The roller guidance of the reach carriage minimizes the frictional forces occurring during a reach operation. In order to support the weight of the load and the torque resulting from this, two rollers are preferably arranged on each side of the lift frame, in each case one of the two rollers being supported on the upper guide rail and the respective second roller on the lower guide rail.

One embodiment has the rollers for guiding the reach carriage fixed to the lift carriage, and the guide rails fixed to the reach carriage.

In order to displace the reach carriage, a hydraulic reach cylinder can be provided on each side of the lift frame and can be fixed at one end to the lift carriage and at the other end to the reach carriage. The reach cylinder can be designed as a double-acting hydraulic cylinder and produces the necessary force for displacing the reach carriage in both directions.

An advantageous development of the invention provides a means for synchronizing the movements of the reach cylinders. It is ensured that the extension length of the two reach cylinders is always identical, as a result of which canting of the reach carriage is avoided.

An expedient development of the invention provides that the reach carriage can be tilted relative to the lift carriage. By tilting the load pick-up means rearward, the load on the load pick-up means can be stabilized, in particular it is possible virtually to eliminate the load slipping off forwards. In the case of the present arrangement, the load pick-up means can be tilted together with the reach carriage.

According to a possible embodiment, in order to adjust the tilt of the reach carriage, on each side of the lift frame at least one of the rollers guiding the reach carriage can be adjusted in the vertical direction. The adjustable rollers can thus be moved in the vertical direction relative to the component to which they are fixed. The fact that the position of the rollers relative to the guide rails is defined means that the tilt of the reach carriage can be set by adjusting the aforementioned rollers.

A particularly simple arrangement results if the adjustable rollers are mounted by means of a rotatable eccentric. In order to adjust the tilt of the reach carriage, the eccentric bearing of the aforementioned rollers is adjusted.

In order to tilt the reach carriage, each adjustable roller can be assigned a hydraulic tilt cylinder. The adjustment of these rollers is, therefore, carried out by the force of the aforementioned hydraulic tilt cylinders.

According to another possible embodiment, the adjustment of the tilt of the reach carriage can be achieved by the rollers for guiding the reach carriage, and the guide rails, being arranged in such a way that when the reach carriage is displaced forwards, a rearward adjustment of the tilt of the reach carriage is automatically carried out.

For this purpose, it is expedient if the upper and lower guide rails are not parallel to each other. The vertical alignment of the front and rear rollers relative to the reach carriage is thereby changed automatically when the reach carriage is shifted forwards or rearwards.

In this case, the guide rails are preferably inclined with respect to the horizontal in such a way that when the reach carriage is displaced, the end of the load pick-up means remote from the lift frame does not change its vertical position. In spite of the automatic tilting of the load pick-up means when the reach carriage is displaced, the tip of the load pick-up means remains at the same height. This means that after the reach carriage has been displaced, no renewed vertical positioning of the load pick-up means is necessary.

A simple construction of the load handling device results if the reach cylinders provided in the area of the lift carriage, and at least one further hydraulic load provided in the area of the lift carriage, for example, a tilt cylinder or a side shift cylinder, are supplied by means of a common hydraulic feed line. A side shift cylinder can be used to position the load pick-up means in the transverse direction of the industrial truck. At the same time, the load pick-up means can be displaced relative to the reach carriage. The aforementioned hydraulic loads can be supplied by a single feed line.

In order to drive the hydraulic loads, in the area of the load handling device, there is arranged at least one electrically driveable, hydraulic directional valve, with which the reach cylinders and the further hydraulic loads can optionally be connected to the feed line.

BRIEF DESCRIPTION OF THE DRAWINGS

Further advantages and details of the invention will be explained in more detail using the exemplary embodiments illustrated in the schematic figures, in which.

DESCRIPTION OF THE PREFERRED EMBODIMENTS

Figure 1:
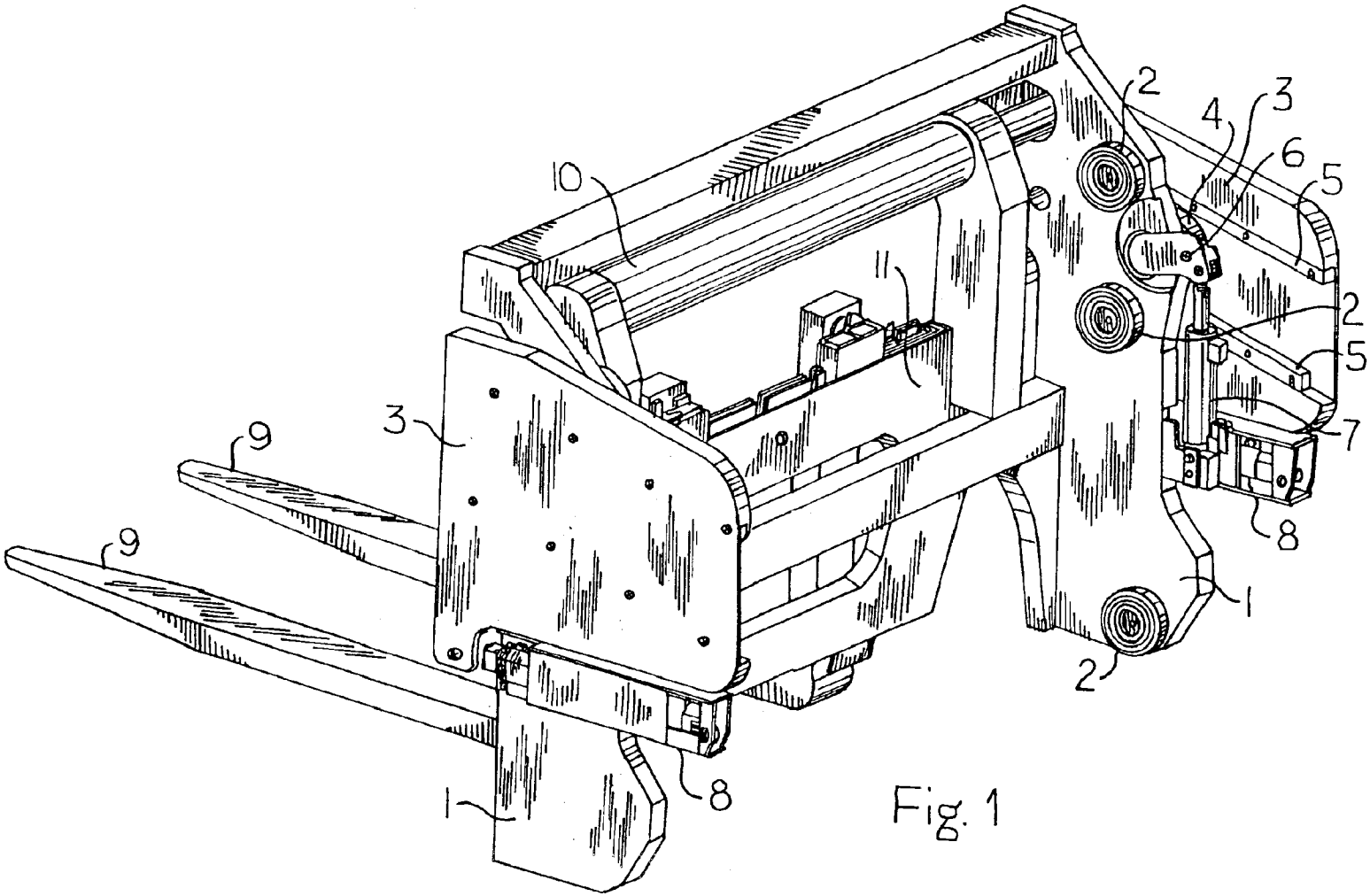
FIG. 1 shows a load handling device according to the invention.

FIG. 1 shows a load handling device according to the invention having a lift carriage 1, which is guided by means of rollers 2 (first rollers) on a lift frame (not illustrated). Here, the rollers 2 engage from the outside in the lift frame, whose movable mast parts are arranged on the outside and whose mast parts which cannot be moved vertically are arranged on the inside. A reach carriage 3 is guided on the lift carriage 1 by means of rollers 4 (second rollers) such that it can be displaced, the rollers 4 being fixed to the lift carriage 1, and the guide rails 5 assigned to the rollers 4 being fixed to the reach carriage 3. The force necessary for the reach movement of the reach carriage 3 is produced by means of two hydraulic reach cylinders 8. The tilt of the reach carriage 3 relative to the lift carriage 1 can be set by means of an eccentric adjustment of the rear rollers 4, the adjustment of the tilt being carried out by means of a lever 6 and a hydraulic tilt cylinder 7. An identical arrangement with a lever and a tilt cylinder is located on the other side of the load handling device, but is covered by the reach carriage 3. Fixed to the reach carriage 3 by means of a fork carrier 11 is a load pick-up means 9 designed as load forks, it being possible for the fork carrier 11 to be displaced in the transverse direction of the industrial truck, with respect to the reach carriage 3, by means of a sliding guide. The force necessary for this can be produced by means of a hydraulic side shift cylinder 10.

Figure 2:
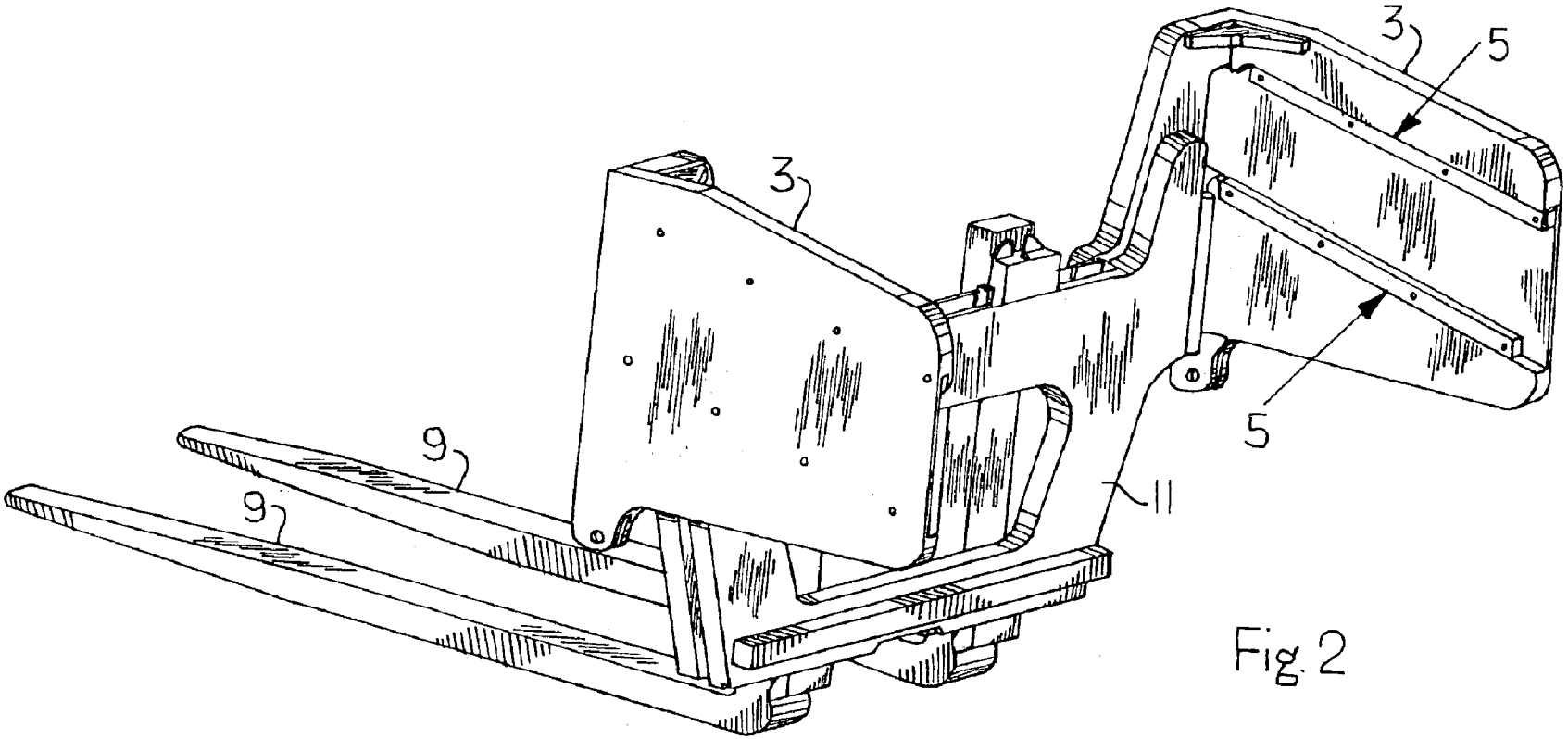
FIG. 2 shows a reach carriage with a load pick-up means.

FIG. 2 shows the reach carriage 3, the fork carrier 11, and the load pick-up means 9 according to FIG. 1. Visible in particular are the guide rails 5 which are arranged on the reach carriage and which engage with the rollers 4 (FIG. 1) on the lift carriage 1 (FIG. 1).

Figure 3:
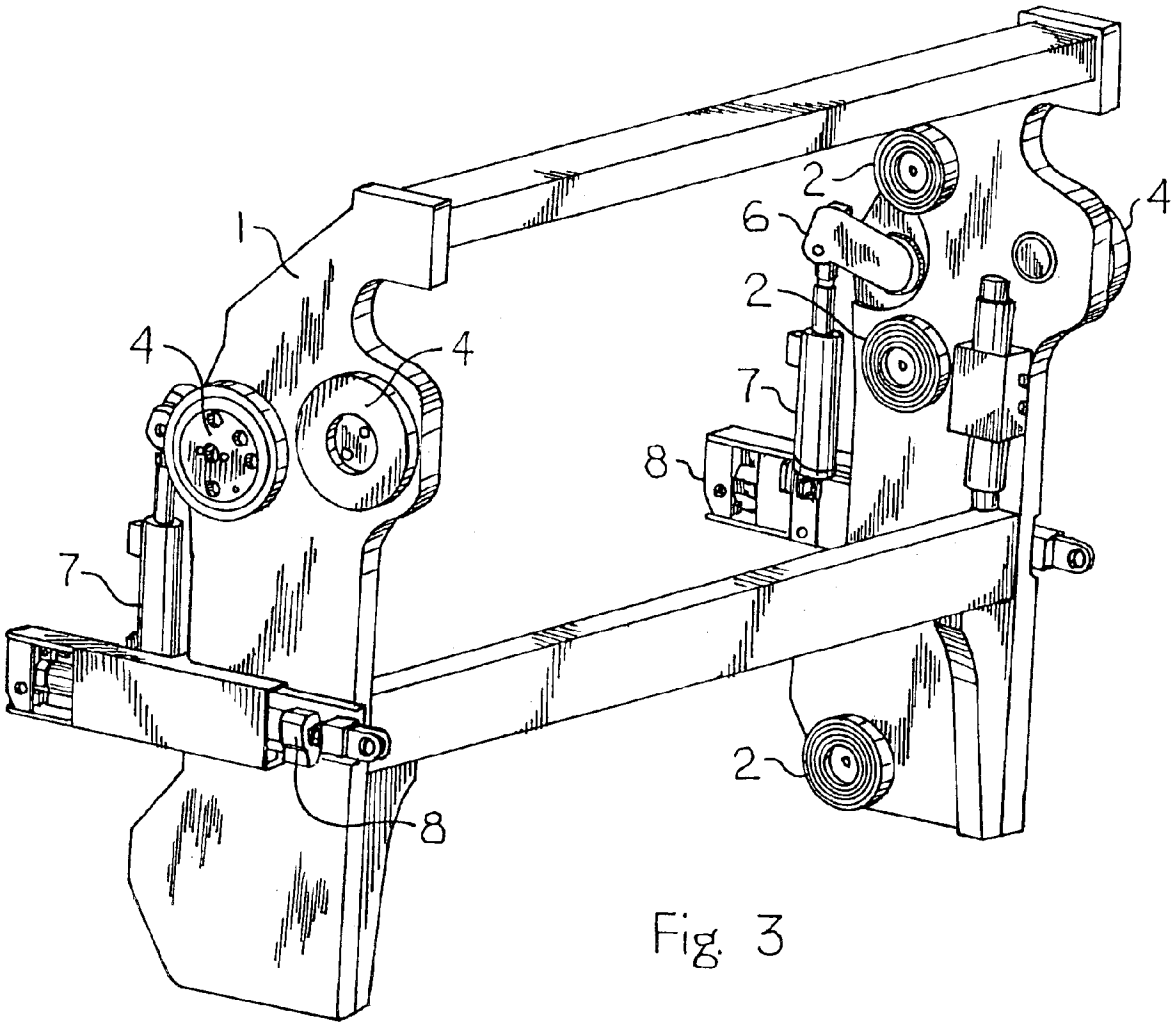
FIG. 3 shows a lift carriage.

In FIG. 3, the lift carriage 1, according to FIG. 1, is depicted on the position rotated through 180°. Visible in particular are the rollers 4 which are mounted on the lift carriage 1 and are provided to engage with the guide rails 5 (FIG. 1) of the reach carriage 3 (FIG. 1). The roller 4 on the left in the figure can be moved in the vertical direction by the hydraulic tilt cylinder 7, by the roller being pivoted about an eccentric bearing point on the lift carriage 1. By means of this tilt device, the tilt of the reach carriage 3, and, therefore, of the load pick-up means 9, can be set as desired by the operator. Alternatively or additionally, an automatic tilt device can be provided, with which the tilt of the load pick-up means 9 is forcibly predefined on the basis of the position of the reach carriage 3.

Figure 4:
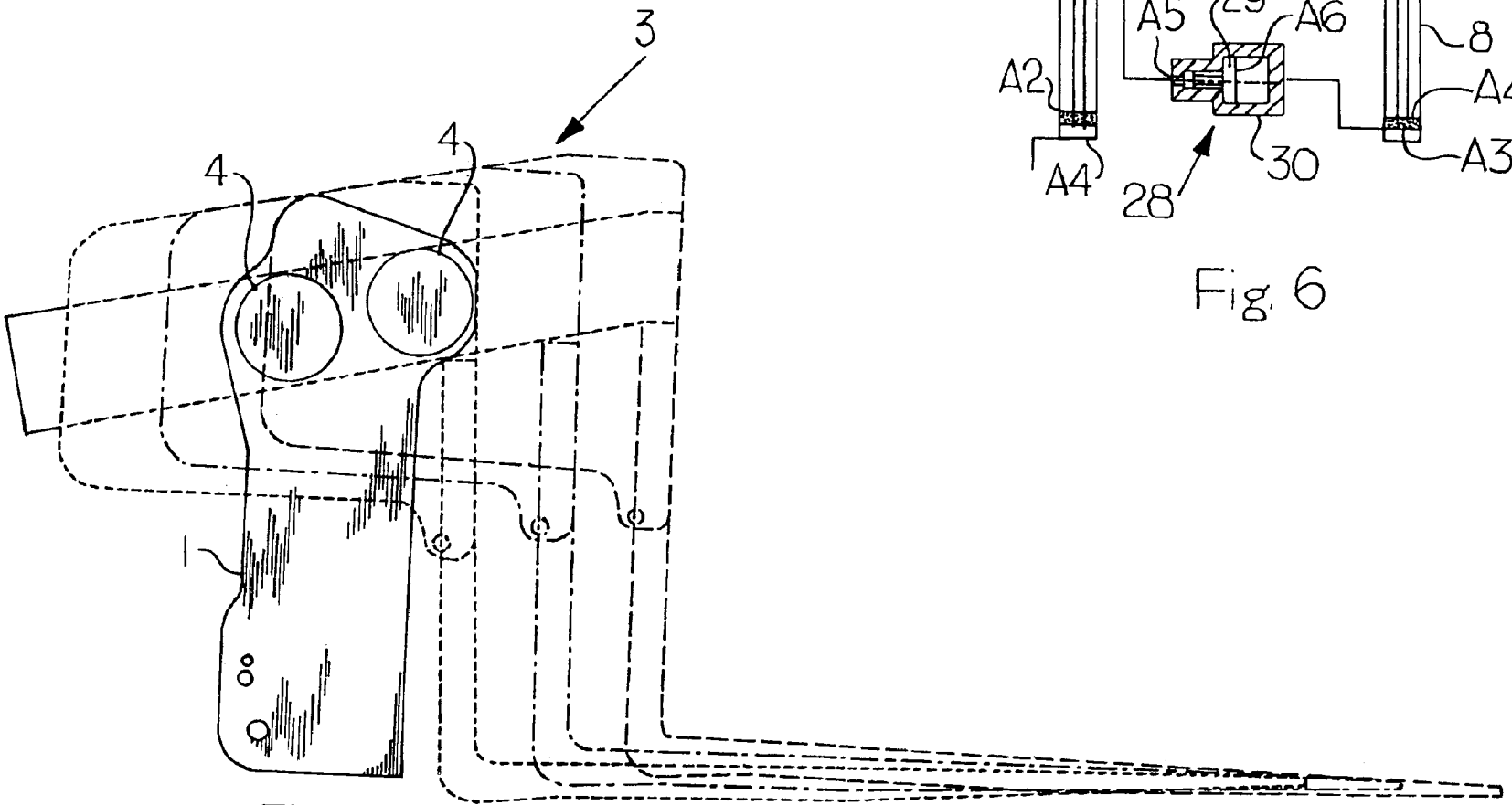
FIG. 4 shows a geometric arrangement of the rollers and of the guide rails.

FIG. 4 illustrates the geometric arrangement of the rollers 4 and of the guide rails 5 for an automatic tilt device of this type. Illustrated by continuous lines are the lift carriage 1 and the rollers 4 fixed to the lift carriage 1 for guiding the reach carriage 3. The reach carriage 3 and the load pick-up means 9 are illustrated by dotted lines in a pulled-back position, by dash-dotted lines in a central position, and by dashed lines in a shifted-forward position. It can be seen that the fork prongs of the load pick-up means 9 are at least approximately horizontal in the shifted-forward position, while they are tilted rearwards in the pulled-back position. This is achieved by the guide rails 5 on the reach carriage 3 not being parallel to each other but being inclined with respect to each other by a slight angle. Because of the position of the center of gravity of the load, the upper guide rail 5 rolls on the roller 4 on the right in the drawing, while the lower guide rail 5 rolls on the roller 4 on the left in the drawing. In the present exemplary embodiment, the angle between the two guide rails 5 is about 1 to 2°.

The two guide rails 5 are inclined with respect to the horizontal in such a way that the vertical position of the tips of the load pick-up means 9 does not change when the reach carriage 3 is displaced. The angle of inclination with respect to the horizontal and the angle between the two guide rails 5 depend on the geometric relationships between the reach carriage 3 and the load pick-up means 9 and on the desired inclination when the reach carriage 3 is pulled back.

Figure 5:
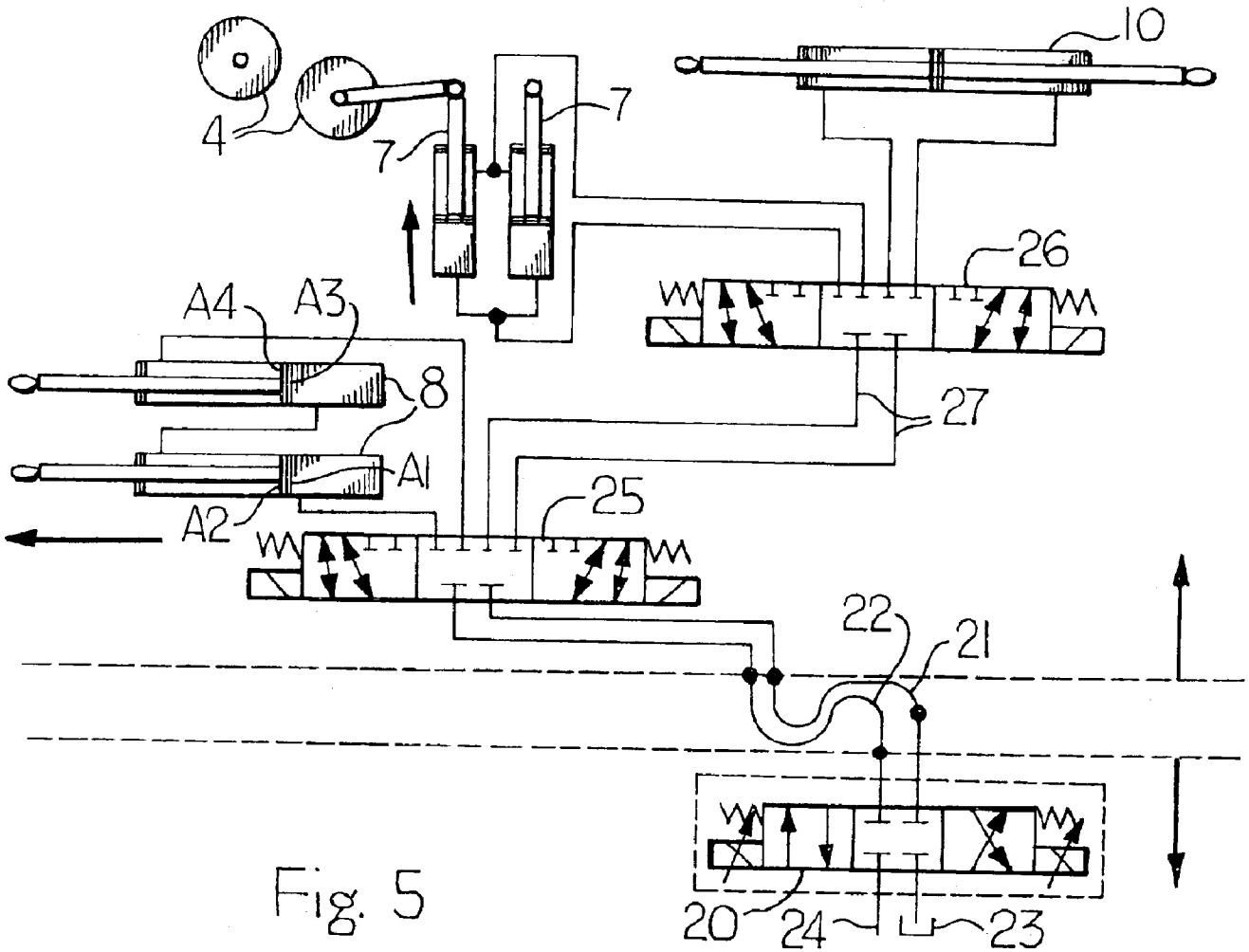
FIG. 5 shows a hydraulic switching arrangement for supplying the load handling device.

FIG. 5 shows a hydraulic switching arrangement for supplying the load handling device. Arranged in the area of a frame of the industrial truck is a hydraulic directional valve 20, with which the lines 21, 22 leading to the load handling device can optionally be closed, connected to an unpressurized tank 23, or connected to a pressure line 24. The directional valve 20 can, therefore, be used to set the direction of movement of the hydraulic loads provided in the load handling device, specifically the reach cylinders 8, the tilt cylinders 7, and the side shift cylinder 10.

The lines 21, 22 are designed as variable-length lines and connect the directional valve 20 arranged on the frame to the load handling device, which can be lifted. In the area of the load handling device, the lines 21, 22 open into a changeover valve 25, which in a neutral position closes the lines 21, 22, in a second position connects the lines 21, 22 to the hydraulic reach cylinders 8, and in a third position connects the lines 21, 22 via intermediate lines 27 to a further changeover valve 26.

This further changeover valve 26 is identical to the changeover valve 25 and in a neutral position closes the intermediate lines 27, in a second position connects the intermediate lines 27 to the tilt cylinders 7, and in a third position connects the intermediate lines 27 to the side shift cylinder 10.

The directional valve 20 and the changeover valves 25, 26 can be driven electrically. The control signals are generated by the operator of the industrial truck by means of electrical signal transmitters, whose output signals are preferably further processed in an electrical controller and then supplied to the control magnets of the valves 20, 25, 26.

In order to avoid canting and jamming of the reach carriage 3 during an advance movement, it is necessary to synchronize the movements of the two reach cylinders 8, that is to say to ensure their synchronism. In the arrangement according to FIG. 5 in which the reach cylinders 8 are illustrated only schematically, this could be achieved by the reach cylinders 8 being designed in such a way that, for the effective piston areas ($A_2$ and $A_3$), it is true that: $A_2=A_3$.

Figure 6:
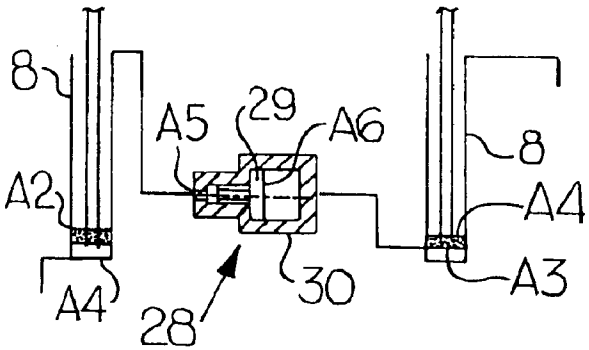
FIG. 6 shows the reach cylinders with a means for synchronizing their movements.

FIG. 6 shows one of several possible alternative arrangements for reach cylinders 8, having a means for synchronizing their movements, two identical reach cylinders 8 being used here. It is, therefore, true that: $A_1=A_3$ and $A_2=A_4$. Arranged in the line connecting the two reach cylinders 8 is a hydraulic converter 28, which comprises a housing 30 and a double piston 29 which can be displaced in the housing 30. In order to achieve synchronism of the reach cylinders 8, it should be true that: $A_2/A_1=A_5/A_6$.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A load handling device for an industrial truck, comprising:

a lift frame;

a lift carriage displaceable along the lift frame;

a reach carriage guided so as to move on the lift carriage; and a load pick-up device arranged on the reach carriage, wherein the lift carriage is guided on the outer sides of the lift frame by first rollers, and wherein the lift carriage includes opposed outer sides and the reach carriage is guided on the outer sides of the lift carriage such that the reach carriage is movable towards and away from the lift carriage.

2. The load handling device according to claim 1, wherein the reach carriage is guided on the lift carriage by second rollers, and the second rollers for guiding the reach carriage on each side of the lift frame are each assigned an upper and a lower guide rail.

3. The load handling device according to claim 2, wherein the second rollers for guiding the reach carriage are fixed to the lift carriage, and the guide rails are fixed to the reach carriage.

4. The load handling device according to claim 3, wherein in order to displace the reach carriage, a hydraulic reach cylinder is provided on each side of the lift frame and is fixed at one end to the lift carriage and at the other end to the reach carriage.

5. The load handling device according to claim 3, wherein the reach carriage is tiltable relative to the lift carriage.

6. The load handling device according to claim 2, wherein in order to displace the reach carriage, a hydraulic reach cylinder is provided on each side of the lift frame and is fixed at one end to the lift carriage and at the other end to the reach carriage.

7. The load handling device according to claim 2, wherein the reach carriage is tiltable relative to the lift carriage.

8. The load handling device according to claim 1, wherein in order to displace the reach carriage, a hydraulic reach cylinder is provided on each side of the lift frame and is fixed at one end to the lift carriage and at the other end to the reach carriage.

9. The load handling device according to claim 4, including means for synchronizing the movements of the reach cylinders.

10. The load handling device according to claim 9, wherein the reach carriage is tiltable relative to the lift carriage.

11. The load handling device according to claim 9, wherein the reach cylinders provided in the area of the lift carriage and at least one further hydraulic load provided in the area of the lift carriage are supplied by a common hydraulic feed line.

12. The load handling device according to claim 8, wherein the reach cylinders provided in the area of the lift carriage and at least one further hydraulic load provided in the area of the lift carriage are supplied by a common hydraulic feed line.

13. The load handling device according to claim 12, wherein in the area of the load handling device there is arranged at least one electrically driveable, hydraulic directional valve with which at least one of the reach cylinders and the at least one further hydraulic load are connectable to the feed line.

14. The load handling device according to claim 12, wherein the further hydraulic load includes at least one of a tilt cylinder and a side shift cylinder.

15. The load handling device according to claim 8, wherein the reach carriage is tiltable relative to the lift carriage.

16. The load handling device according to claim 1, wherein the reach carriage is tiltable relative to the lift carriage.

17. A load handling device for an industrial truck, comprising:

a lift frame;

a lift carriage displaceable along the lift frame;

a reach carriage guided so as to move on the lift carriage; and a load pick-up device arranged on the reach carriage;

wherein the lift carriage is guided on the outer sides of the lift frame by first rollers, wherein the reach carriage is guided on the outer sides of the lift carriage, wherein the reach carriage is tiltable relative to the lift carriage, and wherein the reach carriage is guided on the lift carriage by second rollers and, in order to adjust the tilt of the reach carriage, on each side of the lift frame at least one of the second rollers guiding the reach carriage is adjustable in the vertical direction.

18. The load handling device according to claim 17, wherein the adjustable second rollers are mounted by a rotatable eccentric.

19. The load handling device according to claim 18, wherein in order to tilt the reach carriage, each adjustable second roller is assigned a hydraulic tilt cylinder.

20. The load handling device according to claim 18, wherein the second rollers are movable along upper and lower guide rails, wherein the second rollers for guiding the reach carriage and the guide rails are arranged in such a way that when the reach carriage is displaced forwards, a rearward adjustment of the tilt of the reach carriage is automatically carried out.

21. The load handling device according to claim 17, wherein in order to tilt the reach carriage, each adjustable second roller is assigned a hydraulic tilt cylinder.

22. The load handling device according to claim 21, wherein the second rollers are movable along upper and lower guide rails, wherein the second rollers for guiding the reach carriage and the guide rails are arranged in such a way that when the reach carriage is displaced forwards, a rearward adjustment of the tilt of the reach carriage is automatically carried out.

23. The load handling device according to claim 17, wherein the second rollers are movable along upper and lower guide rails, wherein the second rollers for guiding the reach carriage and the guide rails are arranged in such a way that when the reach carriage is displaced forwards, a rearward adjustment of the tilt of the reach carriage is automatically carried out.

24. A load handling device for an industrial truck, comprising:

a lift frame;

a lift carriage displaceable along the lift frame;

a reach carriage guided so as to move on the lift carriage; and a load pick-up device arranged on the reach carriage, wherein the lift carriage is guided on the outer sides of the lift frame by first rollers, wherein the reach carriage is guided on the outer sides of the lift carriage, wherein the reach carriage is tiltable relative to the lift carriage, and wherein the reach carriage is guided on the lift carriage by second rollers and the second rollers are movable along upper and lower guide rails, wherein the second rollers for guiding the reach carriage and the guide rails are arranged in such a way that when the reach carriage is displaced forwards, a rearward adjustment of the tilt of the reach carriage is automatically carried out.

25. The load handling device according to claim 24, wherein the upper and the lower guide rails are not parallel to each other.

26. The load handling device according to claim 25, wherein the guide rails are inclined with respect to the horizontal in such a way that when the reach carriage is displaced, an end of the load pick-up device remote from the lift frame does not change its vertical position.

* * * * *